US006549093B2

(12) United States Patent
Tsukamoto et al.

(10) Patent No.: US 6,549,093 B2
(45) Date of Patent: Apr. 15, 2003

(54) DIELECTRIC FILTER, DUPLEXER, AND COMMUNICATION APPARATUS INCORPORATING THE SAME

(75) Inventors: Hideki Tsukamoto, Kanazawa (JP); Katsuhito Kuroda, Matto (JP); Jinsei Ishihara, Kanazawa (JP); Hideyuki Kato, Ishikawa-ken (JP)

(73) Assignee: Murata Manufacturing Co. Ltd. (JP)

( * ) Notice: Subject to any disclaimer, the term of this patent is extended or adjusted under 35 U.S.C. 154(b) by 0 days.

(21) Appl. No.: 09/862,927

(22) Filed: May 22, 2001

(65) Prior Publication Data

US 2002/0014931 A1 Feb. 7, 2002

(30) Foreign Application Priority Data

May 22, 2000 (JP) ..... 2000-149980

(51) Int. Cl.[7] ..... H01P 1/213; H01P 1/205
(52) U.S. Cl. ..... 333/134; 333/206; 333/204
(58) Field of Search ..... 333/202, 206, 333/204, 205, 207, 134, 203

(56) References Cited

U.S. PATENT DOCUMENTS

| | | | | | |
|---|---|---|---|---|---|
| 5,124,676 | A | * | 6/1992 | Ueno | 333/206 |
| 5,138,288 | A | * | 8/1992 | Blackburn | 333/134 |
| 5,489,882 | A | * | 2/1996 | Ueno | 333/206 |
| 5,525,946 | A | * | 6/1996 | Tsujiguchi et al. | 333/202 |
| 5,629,656 | A | * | 5/1997 | Tada et al. | 333/202 |
| 5,633,617 | A | * | 5/1997 | Tsujiguchi et al. | 333/206 |
| 5,821,835 | A | * | 10/1998 | Hino | 333/202 |
| 5,831,495 | A | * | 11/1998 | Hino | 333/202 |
| 5,867,076 | A | * | 2/1999 | Tade et al. | 333/206 |
| 5,945,896 | A | * | 8/1999 | Miyamoto | 333/206 |
| 6,002,309 | A | * | 12/1999 | Nishijima et al. | 333/134 |
| 6,008,707 | A | * | 12/1999 | Tada et al. | 333/134 |
| 6,184,760 | B1 | * | 2/2001 | Wada et al. | 333/204 |
| 6,362,705 | B1 | * | 3/2002 | Kuroda et al. | 333/134 |

FOREIGN PATENT DOCUMENTS

| | | | |
|---|---|---|---|
| EP | 0487396 A1 | * | 5/1992 |
| JP | 56116302 | * | 9/1981 |
| JP | 11340706 | | 12/1999 |

OTHER PUBLICATIONS

Wong, "Microstrip Tapped–Line Filter Design", IEEE Trans. on Microwave Theory & Tech., vol. MTT–27, No. 1, Jan. 1979, pp. 45–50.*

* cited by examiner

*Primary Examiner*—Seungsook Ham
(74) *Attorney, Agent, or Firm*—Dickstein, Shapiro, Morin & Oshinsky, LLP.

(57) ABSTRACT

A dielectric filter in which many attenuation poles can be generated, including attenuation poles generated by tap coupling, so that arbitrary passing characteristics and attenuation characteristics can be obtained. In this filter, inside a dielectric block there are formed through-holes having stepped structures in which inner conductors are disposed on the inner surfaces of the holes to capacitively couple the resonators. There are also formed lateral holes having conductive films disposed on the inner surfaces of the holes. The lateral holes are connected to input/output terminals in predetermined positions of the inner conductors. Further, terminal electrodes may be disposed adjacent to predetermined positions of the inner conductors. With this arrangement, attenuation poles are generated by both distributed constant resonator coupling and tap coupling on the low frequency side and/or the high frequency side of a pass band.

13 Claims, 8 Drawing Sheets

DIELECTRIC FILTER, DUPLEXER, AND COMMUNICATION APPARATUS INCORPORATING THE SAME

BACKGROUND OF THE INVENTION

1. Field of the Invention

The present invention relates to dielectric filters using dielectric members having resonance lines formed thereon or therein, duplexers, and communication apparatuses incorporating the same.

2. Description of the Related Art

Conventionally, a dielectric filter including a plurality of resonance lines formed on a dielectric substrate or inside a dielectric block is used as a band pass filter in a communication apparatus such as a mobile phone.

Japanese Unexamined Patent Application Publication No. 11-340706 provides a dielectric filter in which the attenuation-pole frequency of the filter can be freely set and good preferred characteristics can be obtained with a simple structure.

In the dielectric filter, an attenuation pole is generated by connecting input/output terminals to positions deviated from the center of a resonator in the direction of one of its end faces, that is, by so-called tap coupling.

In the dielectric filter having input/output terminals with tap coupling, according to the positions of tap coupling with the resonators, the position of a generated attenuation pole can be set over a relatively wide range. Thus, there is an advantage in that preferred passing characteristics and attenuation characteristics can be more freely set. However, the structure of the resonator inherently dictates the positional relationships between the pass band and the attenuation pole, for example, whether an attenuation pole is generated on the high frequency side or the low frequency side or whether it is generated on both sides. As a result, there are limitations to the freedom to generate attenuation characteristics on the high frequency side and the low frequency side.

SUMMARY OF THE INVENTION

The present invention provides a dielectric filter, a duplexer, and a communication apparatus which avoid these limitations. The dielectric filter can obtain arbitrary passing characteristics and attenuation characteristics by generating many more attenuation poles, in addition to attenuation poles generated by tap couplings.

According to a first aspect of the present invention, there is provided a dielectric filter including a dielectric member, a ground electrode and a plurality of resonance lines formed on the dielectric member, and input/output units tap-coupled with the resonance lines. In this filter, predetermined resonance lines are disposed adjacent to each other to permit distributed constant resonator coupling so that a first attenuation pole is generated on one of the high frequency side and the low frequency side of a pass band, and the tap coupling permits a second attenuation pole to be generated on one of the high frequency side and the low frequency side of the pass band.

As mentioned here, attenuation characteristics obtained on the high frequency side and the low frequency side can be arbitrarily determined by setting either one or both of the first attenuation pole generated by the distributed constant resonator coupling and the second attenuation pole generated by the tap coupling onto the high frequency side, the low frequency side, or both sides of the pass band.

Furthermore, in addition to the second attenuation pole generated by the tap coupling mentioned above, the invention permits attenuation poles to be generated on the high frequency side and the low frequency side by capacitive coupling and inductive coupling between resonators. In this filter, one end of each resonance line may be an open-circuited end and the other end thereof may be a short-circuited end.

Additionally, the resonance line may have a stepped structure in which the line width of the open-circuited end is differentiated from the line width of the short-circuited end. In this case, since there is no need for a special electrode to couple the resonators, attenuation characteristics on the high and low frequency sides of the pass band can be freely determined.

In addition, in this filter, the first attenuation pole obtained by distributed constant resonator coupling may be generated on the low frequency side, and at least two second attenuation poles obtained by tap coupling may be generated on the high frequency side. With this arrangement, for example, a spurious mode response appearing on the high frequency side of the pass band can be suppressed.

In addition, in this filter, all of the first attenuation pole obtained by the distributed constant resonator coupling and the second attenuation poles obtained by the tap coupling may be generated in mutually adjacent positions on the high frequency side or the low frequency side. This arrangement can provide large attenuation at the two attenuation poles.

In addition, two attenuation poles of one type, such as second attenuation poles obtained by tap coupling, may be generated respectively on the high and low frequency sides, and an attenuation pole of another type, such as a first attenuation pole obtained by distributed constant resonator coupling, may be generated respectively on the low or the high frequency side.

Furthermore, in this filter, one end of each of the resonance lines may be an open-circuited end and the other end thereof may be a short-circuited ends, to form a ¼-wavelength resonator. Or, both ends of each of the resonance lines may be short-circuited ends to form a ½-wavelength resonator. With this arrangement, at least two attenuation poles generated by tap coupling can be obtained on the high frequency side of the pass band.

Furthermore, in the dielectric filter of the invention, both ends of each resonance line may be open-circuited ends, to form a ½-wavelength resonator. This arrangement permits attenuation poles to be generated on both of the high frequency side and the low frequency side.

Furthermore, the dielectric member may be a substantially rectangular parallelepiped dielectric block. Inside the dielectric block there may be formed through-holes having inner conductors disposed on the inner surfaces thereof to constitute the resonance lines. With this arrangement, since the $Q_0$ of the resonator can be increased, unnecessary coupling between the resonance lines and the outside can be prevented.

In addition, in this filter, the input/output units may include input/output terminal electrodes disposed on outer surfaces of the dielectric block and conductive films disposed in lateral holes continuing from the input/output terminal electrodes to predetermined positions of the through-holes. With this arrangement, the lateral holes can be formed and the conductive films can be disposed on the inner surfaces of the lateral holes in the same manner as the formation of the through-holes and the addition of the inner conductors on the inner surfaces of the through-holes. This arrangement facilitates tap coupling.

According to a second aspect of the present invention, there is provided a duplexer including two dielectric filters as described above, for use as a reception filter and a transmission filter, and input/output terminals for being connected to a common antenna, which are disposed between the two dielectric filters.

In addition, according to a third aspect of the invention, there is provided a communication apparatus including the dielectric filter or the duplexer as described above, which is used for selectively passing/blocking signals.

Other features and advantages of the present invention will become apparent from the following description of embodiments of the invention which refers to the accompanying drawings.

DETAILED DESCRIPTION OF EMBODIMENTS OF THE INVENTION

First, a description will be given of the relationships between the basic structure of a dielectric filter of the present invention and the characteristics of the filter with reference to FIGS. 1A, 1B, 1C, 2, 3A, 3B, 4A, 4B, 4C, and 4D.

Figure 1A:
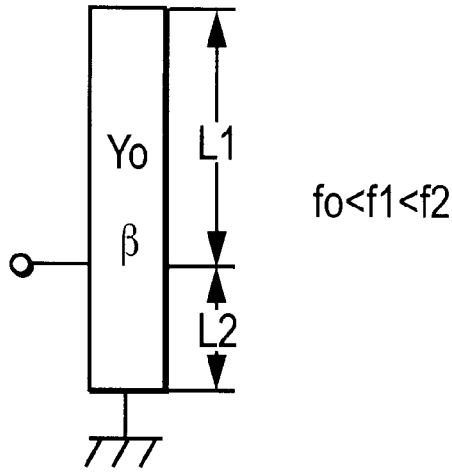
FIGS. 1A, 1B, and 1C show relationships between attenuation-pole frequencies and resonance frequencies for various types of resonators and tap couplings.
Figure 1B:
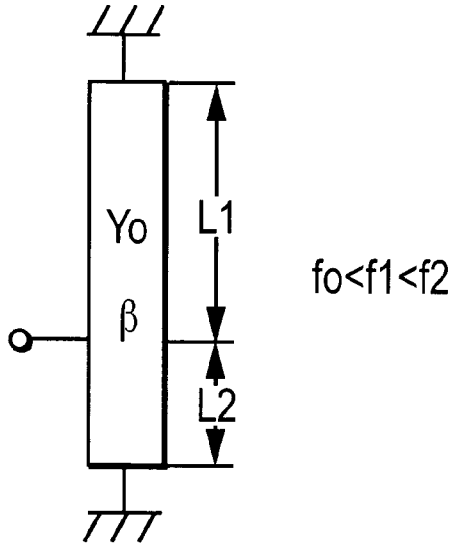
Figure 1C:
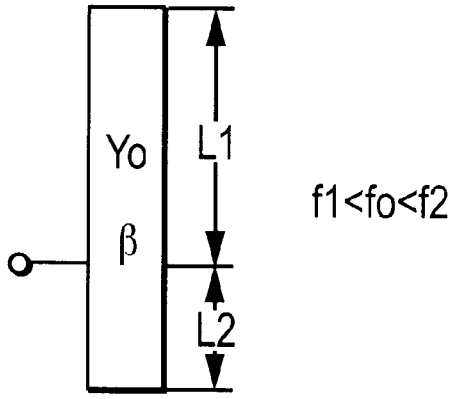

FIGS. 1A to 1C show examples of inputting/outputting by tap-coupling with resonators. FIG. 1A shows the example of a ¼-wavelength resonator whose one end is short-circuited and the remaining end is open-circuited. When the admittance of the resonance line of the resonator is $Y_0$ and the phase constant is β, the susceptance B of the resonator is expressed as:

$$B=Y_0 \cot \beta L(L=L1+L2)$$

The resonator resonates at B=0. Thus, with $\beta L=\pi/2$, the resonator resonates at a frequency $f_0$ determined by:

$$L=\lambda_0/4$$

$\lambda_0=4L$ ($\lambda_0$: resonance frequency wavelength)

On the other hand, a susceptance B obtained from the tapping position is expressed as:

$$B=Y_0 \tan \beta L1+Y_0 \cot \beta L2$$

As a result, an attenuation pole is generated at B=∞ as a state of anti-resonance.

The condition of B=∞ is one of the following cases.

$$Y_0 \tan \beta L1=\infty \quad (1)$$

$$Y_0 \cot \beta L2=\infty \quad (2)$$

In the condition (1), $\beta L=\pi/2$.

$$\therefore L1=\lambda 1/4$$

$\lambda 1=4L1$ ($\lambda 1$: wavelength of attenuation-pole frequency A)

Similarly, in the condition (2), $\beta L2=\pi$.

$$\therefore L2=\lambda 2/2$$

$\lambda 2=2L2$ ($\lambda 2$: wavelength of attenuation-pole frequency B)

As a result, the relationship between the resonance frequency $f_0$ and the attenuation-pole frequencies f1 and f2 is expressed as:

$$\lambda_0>\lambda 1>\lambda 2$$

$$f_0<f1<f2$$

Thus, two attenuation poles as second attenuation poles are generated by the tap coupling at high resonance frequencies.

The resonator shown in FIG. 1B is a half-wavelength resonator whose both ends are short-circuited. When the admittance of the resonance line of the resonator is $Y_0$ and the phase constant is β, the susceptance B of the resonator is expressed as:

$$B=Y_0 \tan \beta L(L=L1+L2)$$

The resonator resonates at B=0. Thus, with $\beta L=\pi$, the resonator resonates at a frequency $f_0$ determined by:

$$L=\lambda_0/2$$

$\lambda_0=2L$ ($\lambda_0$: resonance frequency wavelength)

On the other hand, since a susceptance B obtained from the tapping position is expressed as:

$$B=Y_0 \cot \beta L1+Y_0 \cot \beta L2$$

As a result, an attenuation pole is generated at B=∞ as the state of anti-resonance.

The condition of B=∞ is one of the following cases.

$$Y_0 \cot \beta L1=\infty \quad (1)$$

$$Y_0 \cot \beta L2=\infty \quad (2)$$

In the condition (1), $\beta L1=\pi$.

$$\therefore L1=\lambda 1/2$$

$\lambda 1=2L1$ ($\lambda 1$: wavelength of attenuation-pole frequency A)

Similarly, in the condition (2), $\beta L2=\pi$.

$$\therefore L2=\lambda 2/2$$

$\lambda 2=2L2$ ($\lambda 2$: wavelength of attenuation-pole frequency B)

Thus, the relationship between the resonance frequency $f_0$ and the attenuation-pole frequencies f1 and f2 is expressed as:

$$\lambda_0>\lambda 1>\lambda 2$$

$$f_0<f1<f2$$

As a result, two attenuation poles are generated by the tap coupling at high resonance frequencies.

The resonator shown in FIG. 1C is a half-wavelength resonator whose both ends are open-circuited. The susceptance B of the resonator is expressed as:

$$B=Y_0 \tan \beta L(L=L1+L2)$$

The resonator resonates at B=0. That is, with $\beta L=\pi$, the resonator resonates at a frequency $f_0$ determined by $$L=\lambda_0/2$$

$$\lambda_0=2L \ (\lambda_0\text{: resonance frequency wavelength})$$

On the other hand, since a susceptance B obtained from the tapping position is expressed as:

$$B=Y_0 \tan \beta L1+Y_0 \tan \beta L2$$

Thus, an attenuation pole is generated at $B=\infty$ as the state of anti-resonance.

The condition of $B=\infty$ is one of the following cases.

$$Y_0 \tan \beta L1=\infty \quad (1)$$

$$Y_0 \tan \beta L2=\infty \quad (2)$$

In the condition (1), $\beta L1=\pi/2$.

$$\therefore L1=\lambda ¼$$

$$\lambda 1=4L1 \ (\lambda 1\text{: wavelength of attenuation-pole frequency A})$$

Similarly, in the condition (2), $\beta L2=\pi/2$.

$$\therefore L2=\lambda 2/4$$

$$\lambda 2=4L2 \ (\lambda 2\text{: wavelength of attenuation-pole frequency B})$$

Thus, the relationship between the resonance frequency $f_0$ and the attenuation-pole frequencies f1 and f2 is expressed as:

$$\lambda 1>\lambda_0>\lambda 2$$

$$f1<f_0<f2$$

As a result, attenuation poles are generated by the tap coupling both at high resonance frequencies and low resonance frequencies.

Figure 2:
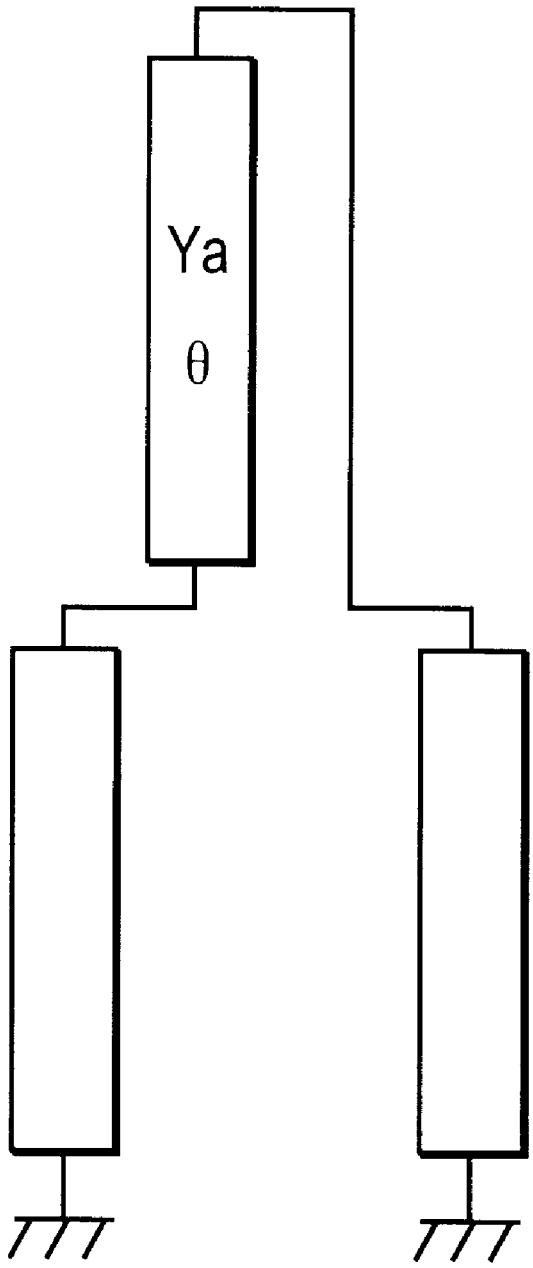
FIG. 2 is an equivalent circuit diagram illustrating distributed constant coupling between two resonators.

FIG. 2 shows the equivalent circuit diagram of a circuit, in which there is shown distributed constant coupling between two resonators. In this case, the admittance B of a coupling portion is expressed as $B=Ya \cot \theta$, which will be shown by an admittance curve in each of FIGS. 3A and 3B.

Figure 3A:
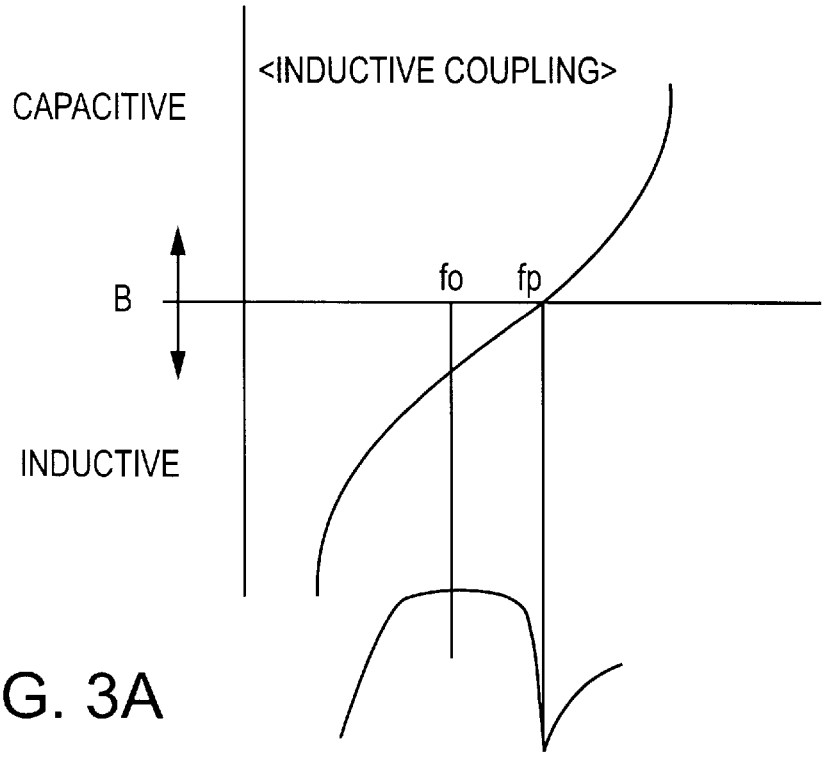
FIGS. 3A and 3B are graphs illustrating the relationships between various manners of distributed constant coupling and the manners in which attenuation poles are generated.
Figure 3B:
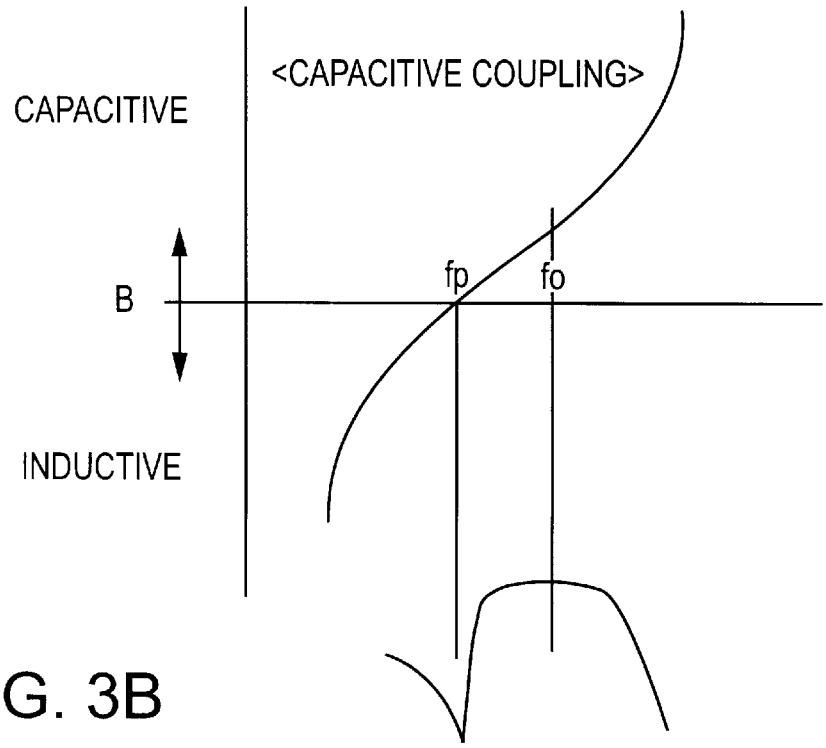

In each of FIGS. 3A and 3B, a frequency fp at B=0 is the frequency of an attenuation pole generated by the distributed constant resonator coupling. When the two resonators are inductively coupled with each other, according to passing characteristics shown in the lower section of FIG. 3A, the central frequency $f_0$ of a pass band is located on a frequency side lower than the attenuation-pole frequency fp. As a result, an attenuation pole is generated on the high frequency side of the pass band.

Additionally, when the two resonators are capacitively coupled with each other, according to passing characteristics shown in the lower section of FIG. 3B, the central frequency $f_0$ of the pass band is located on a frequency side higher than the attenuation-pole frequency fp. As a result, an attenuation pole is generated on the low frequency side of the pass band by the distributed constant resonator coupling.

FIGS. 4A to 4D show how attenuation poles are generated by the tap couplings and the distributed constant resonator couplings. In these figures, there are shown the passing characteristics of four examples.

Figure 4A:
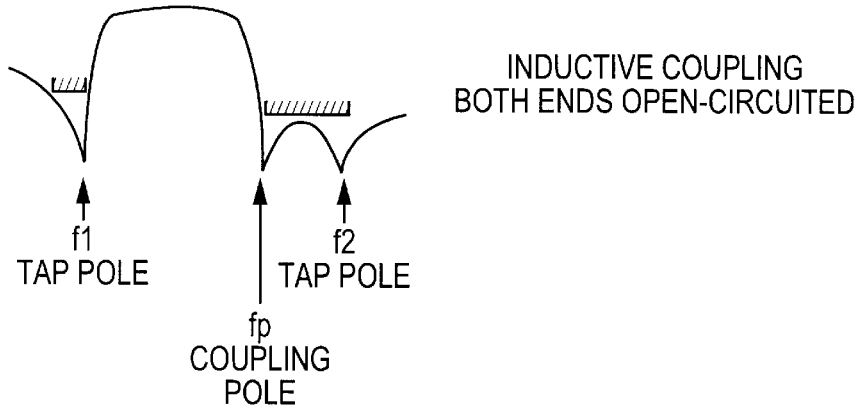
FIGS. 4A to 4D show examples of attenuation poles generated by distributed constant couplings and tap couplings.

In the case of inductive coupling between half-wavelength resonators in which both ends of each resonator are open-circuited, as shown in FIG. 4A, an attenuation pole obtained by inductive coupling is generated on the high frequency side of a pass band. Additionally, two attenuation poles (hereinafter referred to as tap poles) obtained by tap couplings to the resonators are generated on the high and low frequency sides of the pass band. On the high frequency side of the pass band, in a range from the attenuation-pole frequency fp to a tap-pole frequency f2, sufficient attenuation can be obtained over a predetermined bandwidth. Thus, attenuation characteristics obtained on the high frequency side of the pass band can be improved.

Figure 4B:
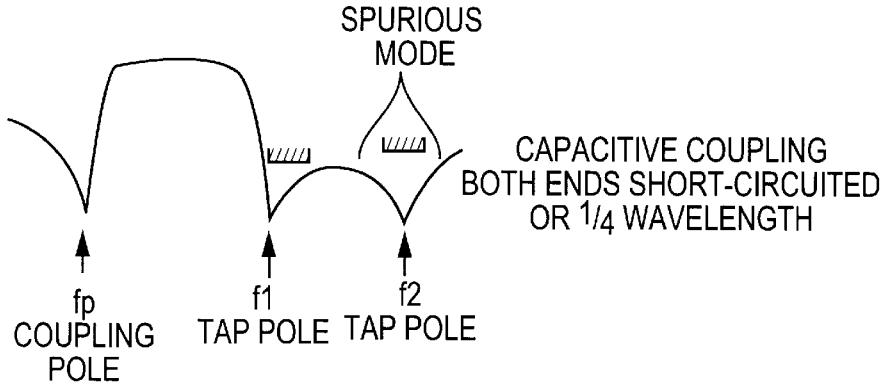

In the case of capacitive coupling between half-wavelength resonators in which both ends of each resonator are short-circuited or ¼-wavelength resonators in which one end of each resonator is short-circuited and the other end thereof is open-circuited, as shown in FIG. 4B, a coupling pole obtained by the capacitive coupling is generated on the low frequency side of the pass band, and two attenuation poles obtained by the tap couplings are generated on the high frequency side. With these characteristics, for example, when the tap-pole frequency f2 coincides with the frequency of a spurious mode such as a TE mode generated in the case of a dielectric block filter, the spurious mode can be effectively suppressed.

Figure 4C:
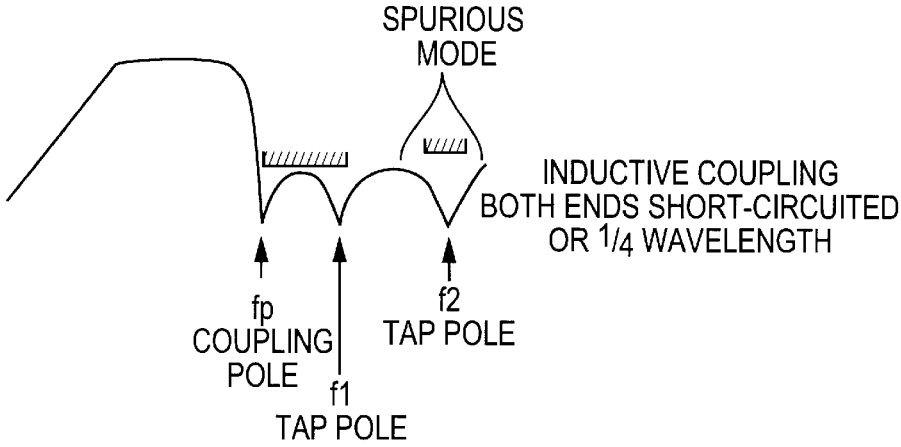

In the case of inductive coupling between half-wavelength resonators in which both ends of each resonator are short-circuited or ¼-wavelength resonators in which one end of each resonator is short-circuited and the other end thereof is open-circuited, as shown in FIG. 4C, an attenuation pole obtained by the inductive coupling is generated on the high frequency side and two attenuation poles obtained by the tap couplings are also generated on the high frequency side of the pass band. With these characteristics, for example, the attenuation characteristics obtained on the high frequency side can be improved, and simultaneously the spurious mode can be suppressed.

Figure 4D:
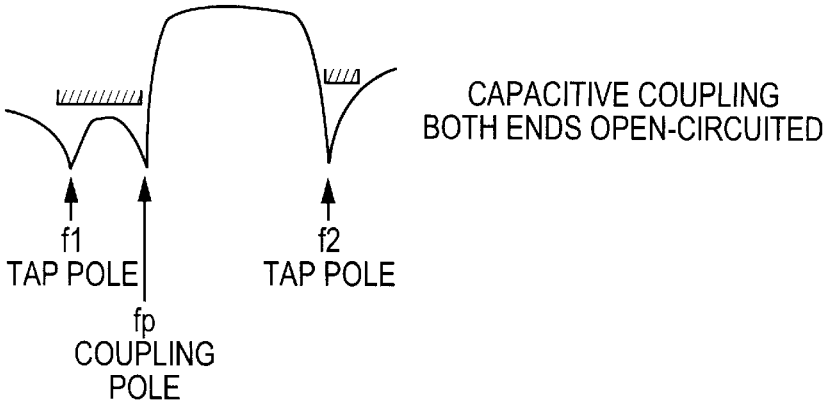

Furthermore, in the case of capacitive coupling between half-wavelength resonators in which both ends of each resonator are open-circuited, as shown in FIG. 4D, an attenuation pole obtained by the capacitive coupling is generated on the low frequency side of the pass band, and two attenuation poles obtained by the tap couplings are generated respectively on the low and high frequency sides of the pass band. As shown here, when the coupling pole and a tap pole are aligned on the low frequency side of the pass band, the attenuation characteristics obtained on the low frequency side can be improved.

In the examples shown in FIGS. 4A to 4D, the tap poles are generated by one tap coupling. However, when a band pass filter is formed with tap coupling in an input unit and also tap coupling in an output unit, respectively, the tap coupling in the input unit generates two tap poles and the tap coupling in the output unit generates two additional tap poles. As a result, in total, four attenuation poles are obtained by the tap couplings. Thus, four tap-pole frequencies can be determined by respectively setting the tap coupling positions of the input-stage resonators and the tap coupling positions of the output-stage resonators. With this arrangement, attenuation characteristics obtained by the four tap-pole frequencies can be determined on either or both of the low frequency side and high frequency side of the pass band.

Next, a detailed description will be given of the structure of the dielectric filter with reference to FIGS. 5A and 5B.

Figure 5A:
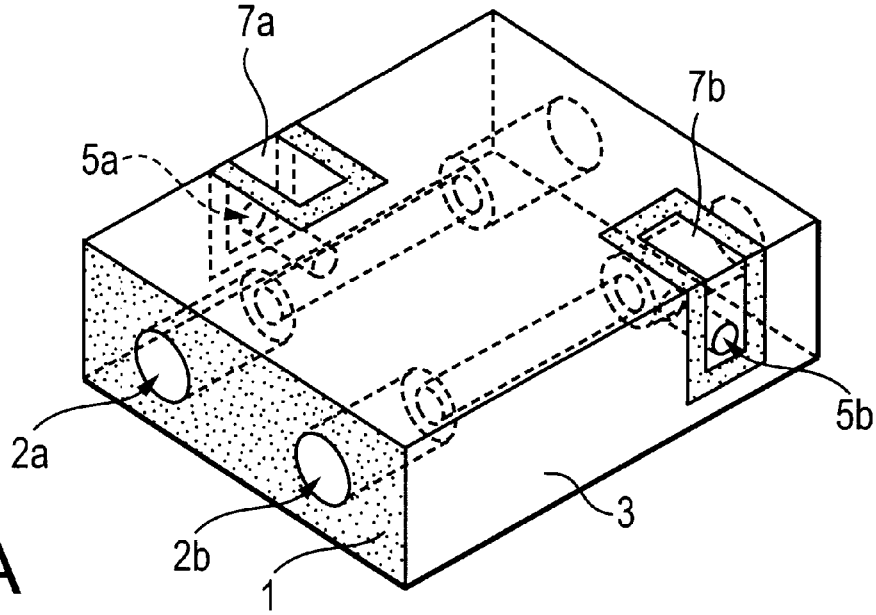
FIG. 5A is a perspective view of a dielectric filter according to an embodiment of the present invention and FIG. 5B shows a sectional view of the dielectric filter.
Figure 5B:
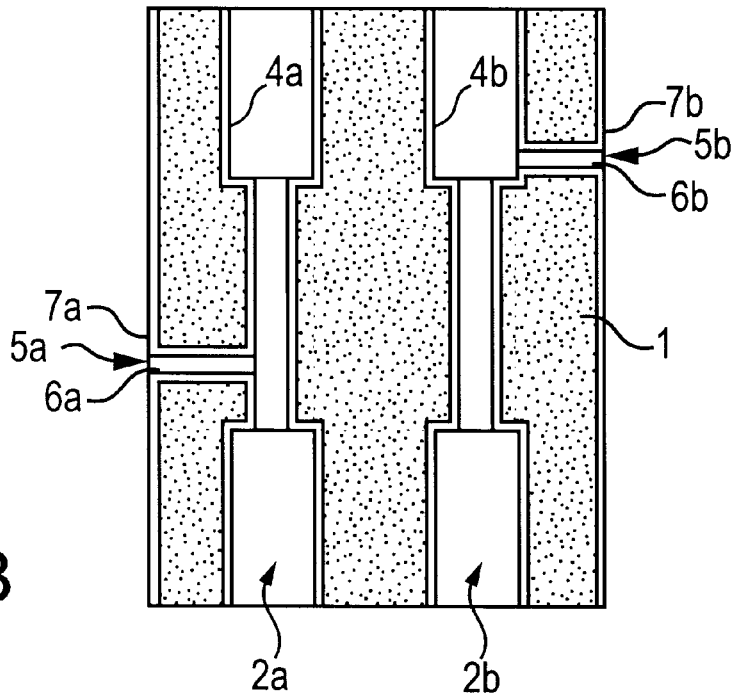

FIG. 5A shows a perspective view of the dielectric filter and FIG. 5B shows a cross-sectional view thereof. In each of the figures, the reference numeral 1 denotes a rectangular parallelepiped dielectric block. Inside the dielectric block, there are formed through-holes 2*a* and 2*b* and lateral holes 5*a* and 5*b*. On the inner surfaces of the through-holes 2*a* and 2*b* are formed inner conductors 4*a* and 4*b*. On the inner surfaces of the lateral holes 5*a* and 5*b* are formed conductive films 6*a* and 6*b*. An outer conductor 3 is formed on four of the outer surfaces of the dielectric block 1, except for the end faces which have the openings of the through-holes 2*a* and 2*b*. With this arrangement, the inner conductors 4*a* and 4*b*, the dielectric block 1, and the outer conductors 3 form two resonators in which both ends of each resonator are open-circuited. The through-holes 2*a* and 2*b* are stepped holes in which the inner diameters near the open-circuited ends of the holes are greater than the inner diameters of the central portions. With this structure, parts having high electric field energy of the resonators are adjacent to permit capacitive coupling between the resonators.

On outer surfaces of the dielectric block 1 are formed input/output terminals 7*a* and 7*b* insulated from the outer conductors 3. Through the conductive films 6*a* and 6*b* disposed on the inner surfaces of the lateral holes 5*a* and 5*b*, predetermined positions of the inner conductors are electrically connected to the input/output terminals 7*a* and 7*b*.

With this arrangement, basically, two tap poles are generated by the respective tap coupling in each of the input unit and the output unit. Since the position of the lateral hole 5*a* is relatively near the center of the through-hole 2*a*, the two tap poles generated by the tap coupling with the lateral hole 5*a* are respectively on the low frequency side and the high frequency side, which are relatively close to a pass band. In contrast, since the position of the lateral hole 5*b* is relatively far from the center of the through-hole 2*b*, the two tap poles generated by the tap coupling with the lateral hole 5*b* are respectively on the low frequency side and the high frequency side, and relatively far from the pass band.

Figure 6:
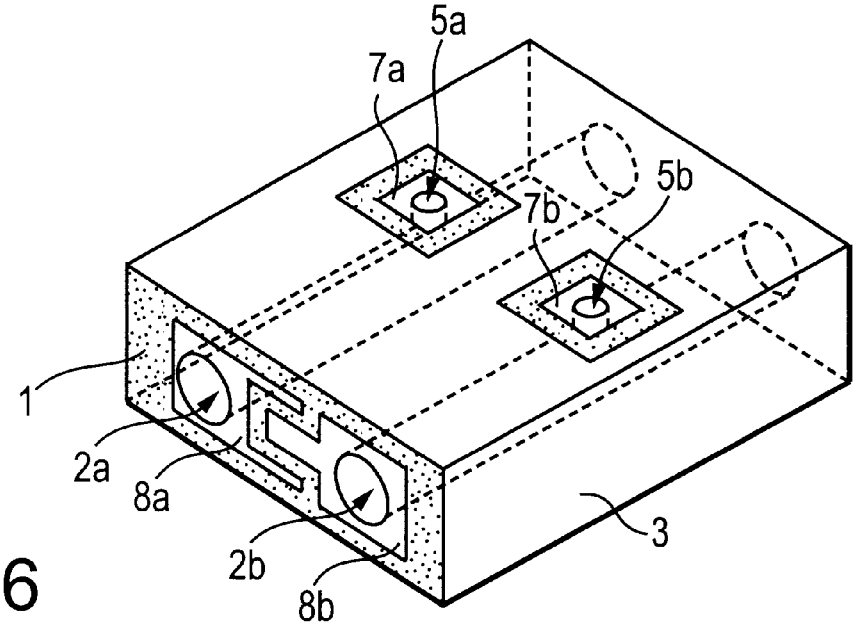
FIG. 6 is a perspective view of a dielectric filter according to another embodiment of the invention.

FIG. 6 shows a perspective view of a dielectric filter having another structure. In this example, inside a dielectric block 1 there are formed through-holes 2*a* and 2*b* and lateral holes 5*a* and 5*b*. On the inner surfaces of the through-holes 2*a* and 2*b* are disposed inner conductors, and on the inner surfaces of the lateral holes 5*a* and 5*b* are disposed conductive films. In addition, an outer conductor 3 is formed on five surfaces of the dielectric block 1, except for the one surface where one opening of each through-hole is formed in the dielectric block 1. With this arrangement, the resonators resonate at ¼ wavelength. In addition, unlike the dielectric filter shown in FIGS. 5A and 5B, on the one of the surfaces where the openings of each of the through-holes 2*a* and 2*b* are formed, there are disposed coupling electrodes 8*a* and 8*b* electrically connected to the inner conductors. The two resonators are capacitively coupled by a capacitance generated between the coupling electrodes 8*a* and 8*b*. Accordingly, the dielectric filter of this example basically shows the characteristics shown in FIG. 4B.

Figure 7:
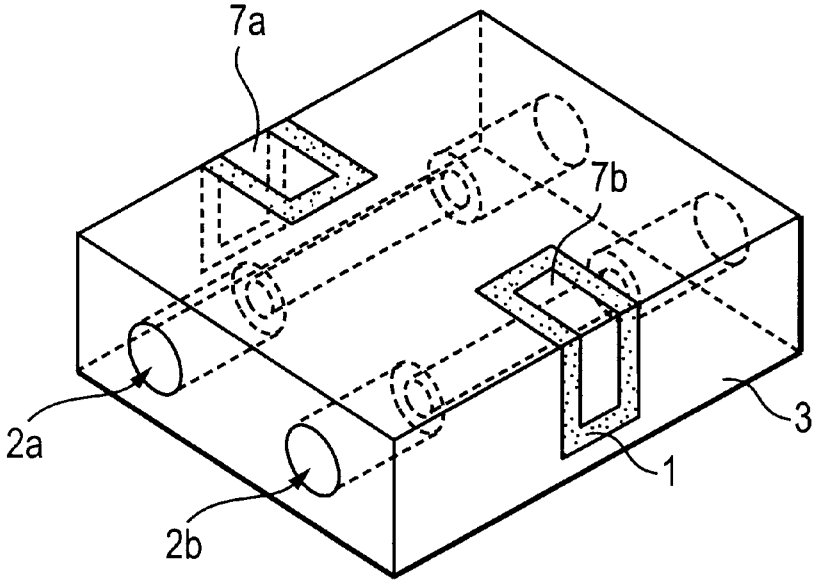
FIG. 7 is a perspective view of a dielectric filter according to another embodiment of the invention.

FIG. 7 also shows a perspective view of a dielectric filter having another structure. In this example, inside a substantially rectangular parallelepiped dielectric block 1 there are formed through-holes 2*a* and 2*b*. On the inner surfaces of the through-holes 2*a* and 2*b* are disposed inner conductors. On the outer surfaces (six surfaces) of the dielectric block 1 are disposed an outer conductor 3. In addition, input/output terminals 7*a* and 7*b* insulated from the outer conductor 3 are formed at predetermined positions. With this arrangement, there can be formed resonators that serve as half-wavelength resonators in which both ends of each resonator are short-circuited. When parts near the short-circuited ends having high magnetic field energies come close to each other, the resonators are inductively coupled. Furthermore, the input/output terminals 7*a* and 7*b* are tap-coupled with the resonators via capacitances generated between the inner conductors disposed on the inner surfaces of the through-holes 2*a* and 2*b* and the input/output terminals 7*a* and 7*b*. With the arrangement, basically, as shown in FIG. 4C, a coupling pole and tap poles are generated on the high frequency side of the pass band.

In the example shown in FIG. 7, the inner diameters near the openings of each of the through-holes are greater than the center inner diameters thereof. In contrast, when the inner diameters of the centers of the through-holes are made greater than the inner diameters of the parts near both ends of the holes, the resonators are capacitively coupled and the characteristics shown in FIG. 4B can be obtained. In addition, when both ends of each through-hole are open-circuited and the center diameter is greater than the diameters of both ends of the through-hole, the resonators are inductively coupled and the characteristics shown in FIG. 4A can be obtained.

Next, a structural example of a duplexer according to an embodiment of the invention will be illustrated with reference to FIG. 8.

Figure 8:
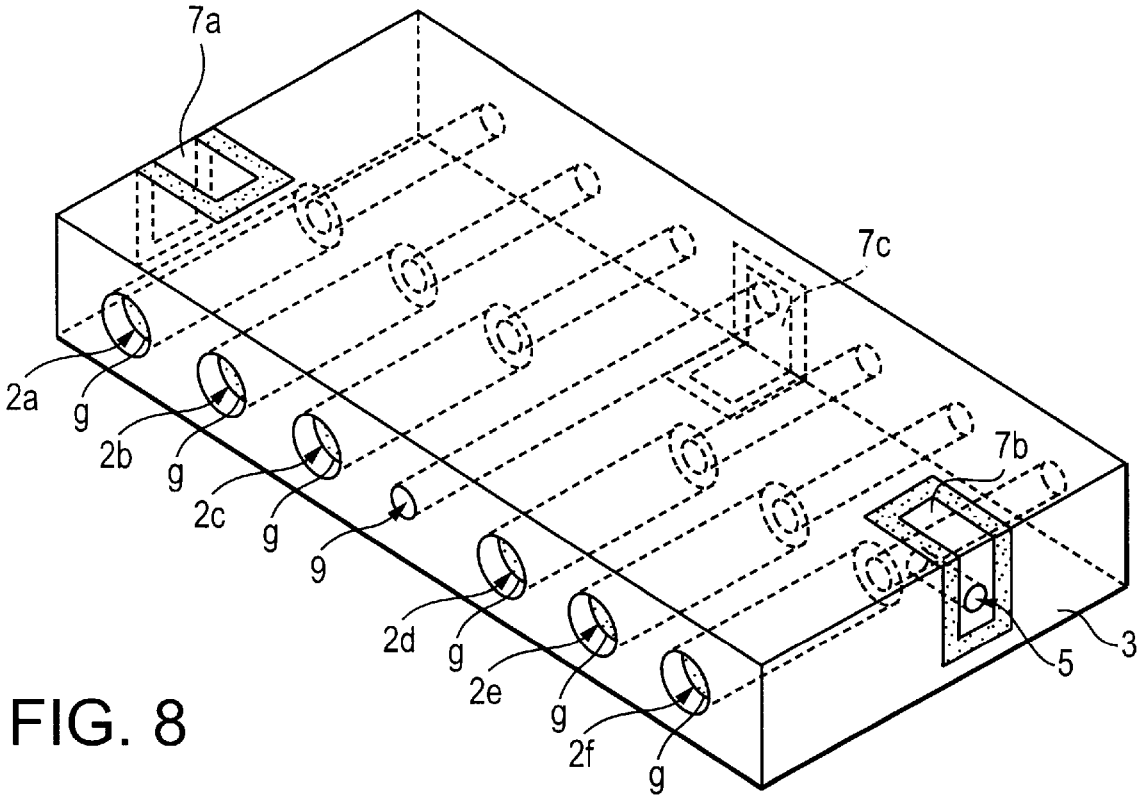
FIG. 8 is a perspective view illustrating the structure of a duplexer according to the invention.

In FIG. 8, inside a rectangular parallelepiped dielectric block there are formed six through-holes 2*a* to 2*f*, a coupling line hole 9, and a lateral hole 5. On the inner surfaces of the through-holes 2*a* to 2*f* are disposed inner conductors. Near the openings at one side of the dielectric block of each of the through-holes 2*a* to 2*f* there is disposed a respective gap g, which generates stray capacitance. On the inner surfaces of the coupling line hole 9 and the lateral hole 5 are disposed conductive films. On the outer surfaces (six surfaces) of the dielectric block 1 there is formed an outer conductor 3 and input/output terminals 7*a*, 7*b*, and 7*c* insulated from the outer conductor 3.

The input/output terminal 7*a* is tap-coupled with the inner conductor via a capacitance in a predetermined position of the through-hole 2*a*. The input/output terminal 7*b* is tap-coupled with the inner conductor in a predetermined position of the through-hole 2*f* via the conductive film disposed on the inner surface of the lateral hole 5. In addition, the input/output terminal 7*c* is electrically connected to the conductive film on the inner surface of the coupling line hole 9 at one of its ends. The conductive film on the inner surface of the coupling line hole 9 is electrically connected to the outer conductor 3 on the side opposed to the side on which the input/output terminal 7*c* is disposed.

In this manner, by disposing the respective gaps g near ends of the through-holes, stray capacitances are generated between the ends of the respective resonance lines and ground. As a result, the adjacent resonators are inductively coupled with each other. In addition, resonators composed of the through-holes 2*c* and 2*d* are interdigitally coupled with the conductive film on the inner surface of the coupling line hole 9. Simultaneously, with this arrangement, the resonators composed of the through-holes 2*c* and 2*d* are not directly coupled with each other.

In FIG. 8, three resonators composed of the through-holes 2*a* to 2*c* serve as a reception filter, and three resonators composed of the through-holes 2*d* to 2*f* serve as a transmission filter. The characteristics of the reception filter are shown in FIG. 4C. By the tap coupling between the input/output terminal 7*a* and the resonator composed of the through-hole 2*a*, basically, two tap poles are generated on the high frequency side of a pass band. In addition, by the inductive coupling between the resonators, a coupling pole is generated on the high frequency side of the pass band. Similarly, the characteristics of the transmission filter are also shown in FIG. 4C. By the tap coupling between the input/output terminal 7*b* and the resonator composed of the through-hole 2*f*, basically, two tap poles are generated on the high frequency side of the pass band, and by the inductive coupling between the resonators, a coupling pole is generated on the high frequency side of the pass band.

In a system in which the transmission frequency band is on the low frequency side of the frequency band used, and the reception frequency band is on the high frequency side thereof, for example, it is considered to make the characteristics of the transmission filter as shown in FIG. 4C, in order to make attenuation characteristics on the high frequency side of the pass band steep, and to make the characteristics of the reception filter as shown in FIG. 4D, in order to make the attenuation characteristics on the low frequency side steep. To provide this arrangement, both ends of each of the resonators included in the transmission filter may be short-circuited to permit inductive coupling between the resonators, and both ends of each of the resonators included in the reception filter may be open-circuited to permit capacitive coupling between the resonators.

In the examples described above, the resonators are formed by forming the through-holes in the dielectric block. As a result, the $Q_0$ of the resonators can be increased, thereby reducing insertion loss. In addition, unnecessary coupling with the outside can be prevented.

Figures 9A, 9B, 9C:
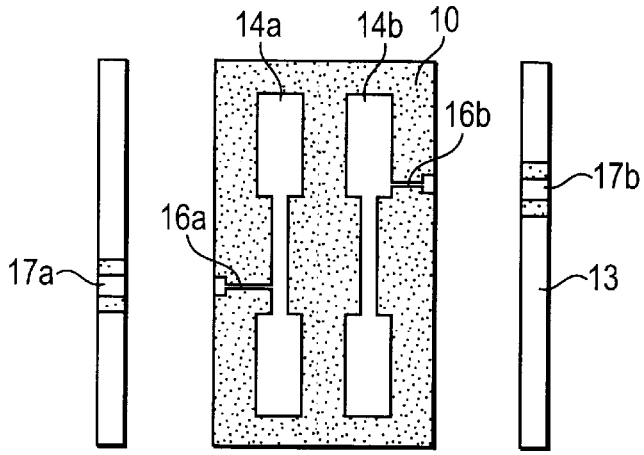
FIGS. 9A to 9D are views illustrating the structure of a dielectric filter using a dielectric substrate.
Figure 9D:
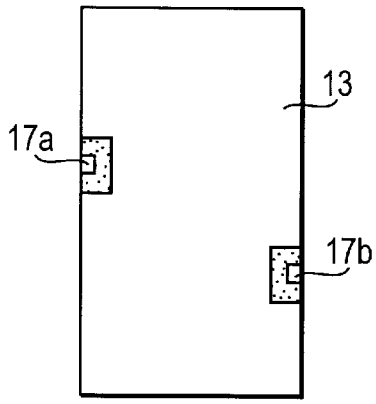

Next, there will be presented a dielectric filter using a dielectric substrate. Each of FIGS. 9A to 9D shows a projection view of the dielectric filter. FIG. 9A shows a left side view of the filter, FIG. 9B shows a front view thereof, FIG. 9C shows a right side view thereof, and FIG. 9D shows a back view thereof. On one of the main surfaces of a dielectric substrate 10 are formed two resonance electrodes 14*a* and 14*b*, and tap connection electrodes 16*a* and 16*b* are connected to predetermined positions of the resonance electrodes 14*a* and 14*b*. From the side surfaces of the dielectric substrate 10 to the back surface thereof there are formed input/output terminals 17*a* and 17*b*, which are electrically connected to the tap connection electrodes 14*a* and 14*b*. A ground electrode 13 insulated from the input/output terminals 17*a* and 17*b* is formed on another surface of the dielectric substrate 1.

The resonance electrodes 14*a* and 14*b* serve as half-wavelength resonators in which both ends of each resonator are open-circuited. In each resonator, the widths near the open ends of the electrode are broader than the width of the center to capacitively couple the resonators. Thus, similar to the dielectric filter shown in FIGS. 5A and 5B, there will be obtained the characteristics shown in FIG. 4D.

Similarly, regarding the dielectric filters and the duplexer shown in FIGS. 6 to 8, by forming resonance lines on dielectric substrates, the dielectric filters and duplexers of such dielectric-substrate types can be formed.

Figure 10:
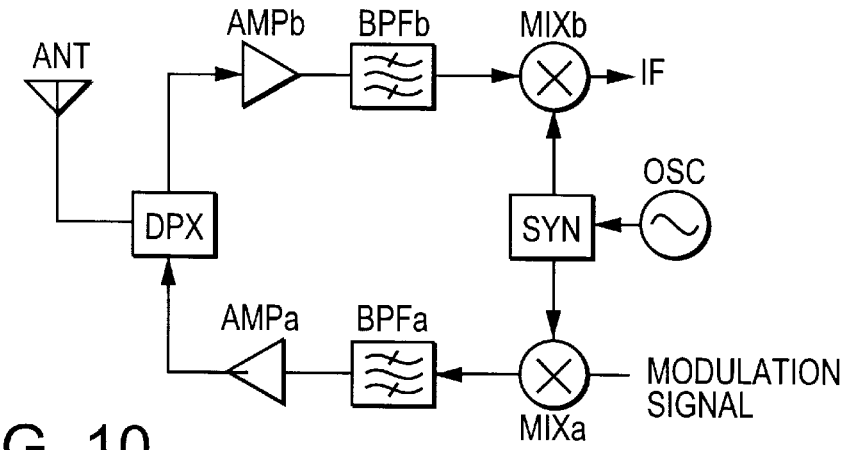
FIG. 10 is a block diagram illustrating the structure of a communication apparatus according to the invention.

Next, a structural example of a communication apparatus of the invention will be illustrated with reference to FIG. 10. In FIG. 10, the reference character ANT denotes a transmission/reception antenna, the reference character DPX denotes a duplexer, the reference characters BPFa and BPFb denote band pass filters, the reference characters AMPa and AMPb denote amplifying circuits, the reference characters MIXa and MIXb denote mixers, and the reference character OSC and SYN denote an oscillator and a frequency synthesizer, respectively.

The MIXa mixes a modulation signal with a signal output from the SYN. The BPFa passes signals of only the transmission frequency band among mixed signals output from the MIXa, and the AMPa amplifies the signals to transmit from the ANT via the DPX. The AMPb amplifies received signals sent from the DPX. The BPFb passes signals of only the reception frequency band among received signals output from the AMPb. The MIXb mixes frequency signals output from the SYN with the received signals to output intermediate frequency signals IF.

Among the constituent components shown in FIG. 10, the dielectric filters and the duplexer shown in FIGS. 5A and 5B to FIGS. 9A to 9D may be used as the band pass filters BPFa and BPFb and the duplexer DPX.

As described above, both of the first attenuation pole generated by the distributed constant resonator coupling and the second attenuation pole generated by the tap coupling are present either on the high frequency side or the low frequency side of the pass band, or on both sides of the pass band. As a result, it is easy to form a dielectric filter and a duplexer having arbitrary attenuation characteristics obtained on the high frequency side or the low frequency side. Thus, a communication apparatus having good communication performance can be easily formed.

In addition, in the present invention, the second attenuation pole is generated by the tap coupling and there is provided the structure in which the resonance-line widths are stepped. As a result, without requiring a specific electrode for coupling between resonators, an attenuation pole can be selectively generated either on the high frequency side or the low frequency side of the pass band, thereby easily obtaining the dielectric filter and the duplexer having a high degree of freedom in its design.

Moreover, in the present invention, as the dielectric member, the rectangular parallelepiped dielectric block can be used. Then, when the resonance lines are formed by inner conductors disposed on the inner surfaces of the through-holes formed in the dielectric block, the $Q_0$ of the resonators can be increased. As a result, unnecessary coupling between the resonator lines and the outside can be prevented.

Furthermore, in the present invention, as input/output ports, input/output terminal electrodes are formed on the outer surfaces of the dielectric block. In addition, there are formed the lateral holes continuing from the input/output terminal electrodes to the predetermined positions of the through-holes. The predetermined positions of the inner conductors are electrically connected to the input/output terminal electrodes via the conductive films disposed on the inner surfaces of the lateral holes. With this arrangement, in the same manner as the formation of the through-holes and the addition of the inner conductors on the inner surfaces of the through-holes, the lateral holes can be formed and the conductive films can be added on the inner surfaces of the lateral holes. As a result, a tap-coupling structure can be easily constituted.

Although the present invention has been described in relation to particular embodiments thereof, many other variations and modifications and other uses will become apparent to those skilled in the art. Therefore, the present invention is not limited by the specific disclosure herein.

What is claimed is:

1. A dielectric filter comprising:

a dielectric member;

a ground electrode and a plurality of resonance lines formed on the dielectric member, the plurality of resonance lines forming a filter having a pass band; and input/output conductors tap-coupled with corresponding ones of the resonance lines;

wherein at least two of the resonance lines are disposed adjacent to each other, the at least two adjacent resonance lines being coupled to each other at respective ends thereof to provide distributed constant resonator coupling so that a first attenuation pole is generated on one of the high frequency side and the low frequency side of the pass band, and the tap coupling provides a second attenuation pole on one of the high frequency side and the low frequency side of the pass band.

2. The dielectric filter according to claim 1, wherein one end of each of the at least two adjacent resonance lines is open-circuited and the other end thereof is short-circuited, and each of the at least two adjacent resonance lines has a stepped structure in which the line width at the open-circuited end is different from the line width at the short-circuited end.

3. The dielectric filter according to claim 1, wherein the first attenuation pole is generated on the low frequency side and at least two second attenuation poles are generated on the high frequency side.

4. The dielectric filter according to claim 1, wherein the first attenuation pole and the second attenuation pole are both generated in mutually adjacent positions on one of the high frequency side and the low frequency side.

5. The dielectric filter according to claim 1, wherein one end of each of the at least two adjacent resonance lines is open-circuited and the other end thereof is short-circuited to form a ¼-wavelength resonator.

6. The dielectric filter according to claim 1, wherein both ends of each of the at least two adjacent resonance lines are open-circuited to form a ½-wavelength resonator.

7. The dielectric filter according to claim 1, wherein both ends of each of the at least two adjacent resonance line are short-circuited to form a ½-wavelength resonator.

8. The dielectric filer according to claim 1, wherein the dielectric member is a substantially rectangular parallelpiped dielectric block, and the at lest two resonance lines are formed by through-holes having inner conductors disposed on respective inner surfaces of the through-holes.

9. The dielectric filter according to claim 8, wherein the input/output conductors comprise input/output terminal electrodes disposed on outer surfaces of the dielectric block and conductive films disposed on the inner surfaces of holes extending respectively from the input/output terminal electrodes to predetermined positions of the through-holes.

10. The dielectric filter according to claim 1, further comprising a high-frequency circuit having at least one of a transmission circuit and a reception circuit electrically coupled to the dielectric filter.

11. A duplexer comprising:

two dielectric filters serving as a reception filter and a transmission filter, respectively, each of the two dielectric filters including:

a dielectric member;

a ground electrode and a plurality of resonance lines formed on the dielectric member, the plurality of resonance lines a filter having a pass band; and input/output conductors tap-coupled with corresponding ones of the resonance lines, wherein at least two of the resonance lines are disposed adjacent to each other, the at least two adjacent resonance lines being coupled to each other at respective ends thereof to provide distributed constant resonator coupling so that a first attenuation pole is generated on one of the high frequency side and the low frequency side of the pass band and the tap coupling provides a second attenuation pole on one of the high frequency side and the low frequency side of the pass band, and wherein one input/output conductor of each filter is connected to a common input/output terminal for an antenna.

12. The duplexer according to claim 11, further comprising a transmission circuit connected to one of said two dielectric filters and a reception circuit connected to the other of said two dielectric filters so as to form a communication apparatus.

13. The duplexer according to claim 12, further comprising an antenna connected to said common input/output terminal.

* * * * *